US009416960B2

(12) United States Patent
Johnson

(10) Patent No.: US 9,416,960 B2
(45) Date of Patent: Aug. 16, 2016

(54) LIGHTING APPARATUS

(71) Applicant: Mark Johnson, Covington, LA (US)

(72) Inventor: Mark Johnson, Covington, LA (US)

(73) Assignee: Bevolo Gas & Electric Lights, Inc., Covington, LA (US)

( * ) Notice: Subject to any disclaimer, the term of this patent is extended or adjusted under 35 U.S.C. 154(b) by 467 days.

(21) Appl. No.: 13/854,753

(22) Filed: Apr. 1, 2013

(65) Prior Publication Data

US 2013/0288188 A1 Oct. 31, 2013

Related U.S. Application Data

(60) Provisional application No. 61/640,307, filed on Apr. 30, 2012.

(51) Int. Cl.

| | |
|---|---|
| ***F23D 14/58*** | (2006.01) |
| ***F23D 14/84*** | (2006.01) |
| ***F21S 13/02*** | (2006.01) |
| ***F21V 19/06*** | (2006.01) |
| ***F21V 37/00*** | (2006.01) |
| ***F23D 14/28*** | (2006.01) |

(Continued)

(52) U.S. Cl.

CPC *F21V 37/00* (2013.01); *F21H 1/04* (2013.01); *F21S 13/02* (2013.01); *F21V 19/06* (2013.01); *F23D 14/28* (2013.01); *F23D 14/583* (2013.01); *F23D 14/84* (2013.01); *F21V 21/116* (2013.01); *F23C 5/02* (2013.01); *F23D 14/08* (2013.01)

(58) Field of Classification Search

CPC ..... F21V 37/00; F21V 19/06; F21V 21/02; F21V 21/116; F23D 14/583; F23D 14/84; F23D 14/28; F23D 14/08; F21S 13/02; F21H 1/04; F23C 5/02; F21L 17/00; F21L 26/00

USPC ..... 431/285, 354, 100, 350, 353; 362/161, 362/229, 415; D26/114

IPC . F23D 14/58, 14/84, 14/28, 14/08; F21S 13/02; F21V 19/06, 21/02; F23C 5/02; F21L 17/00, F21L 26/00

See application file for complete search history.

(56) References Cited

U.S. PATENT DOCUMENTS 10,529 A * 2/1854 Webster et al. ..... 60/522
187,683 A * 2/1877 Wallace ..... F23D 14/28 431/343

(Continued)

FOREIGN PATENT DOCUMENTS

GB 694981 A * 7/1953 ..... F21V 37/00

OTHER PUBLICATIONS

"Gas Valve Orifice Sizing—Sherwood 2003.pdf", Gas Fireplace Service Manual, Sherwood Industries Ltd., p. 20, Aug. 2003.*

(Continued)

*Primary Examiner* — Gregory Huson
*Assistant Examiner* — Daniel E Namay
(74) *Attorney, Agent, or Firm* — John B. Edel; Edel Patents LLC

(57) ABSTRACT

Lighting apparatus suitable for use in a gas lantern lighting fixtures and containing a single piece body member with a horizontally oriented gas inlet, a vertically oriented gas outlet, and a fastener along with a valve; an orifice; and a burner tip connected to one another are disclosed. Lighting apparatus which are easy to assemble and capable of efficiently producing an aesthetically pleasing flame along with associated methods are described.

20 Claims, 4 Drawing Sheets

(51) Int. Cl.

| | |
|---|---|
| *F21V 21/02* | (2006.01) |
| *F23C 5/02* | (2006.01) |
| *F23D 14/08* | (2006.01) |
| *F21V 21/116* | (2006.01) |

(56) References Cited

U.S. PATENT DOCUMENTS

| | | | | | |
|---|---|---|---|---|---|
| 455,483 | A * | 7/1891 | Durand | F23D 14/08 | 431/286 |
| 667,756 | A * | 2/1901 | Wynell | F23D 14/28 | 431/343 |
| 801,473 | A * | 10/1905 | Page, Jr. | F21V 19/06 | 362/381 |
| 837,333 | A * | 12/1906 | McLewee | F23C 5/02 | 431/113 |
| 901,788 | A * | 10/1908 | Damon | F23D 11/10 | 169/37 |
| 915,271 | A * | 3/1909 | Conrow | F23D 14/28 | 431/343 |
| 978,207 | A * | 12/1910 | Ray | F23D 14/28 | 431/343 |
| 1,026,121 | A * | 5/1912 | Pictet | 431/7 | |
| 1,033,967 | A * | 7/1912 | Van Horn | 431/284 | |
| 1,058,007 | A * | 4/1913 | Smith | 431/354 | |
| 1,177,027 | A * | 3/1916 | Ferrier | F23D 14/20 | 431/353 |
| 1,222,084 | A * | 4/1917 | Donaldson | 431/354 | |
| 1,280,859 | A * | 10/1918 | Rutz et al. | 431/285 | |
| 1,295,313 | A * | 2/1919 | Heath | 239/296 | |
| 1,552,558 | A * | 9/1925 | Guthrie | 239/416.4 | |
| 1,590,882 | A * | 6/1926 | Brown | F23D 14/34 | 239/273 |
| 1,765,672 | A * | 6/1930 | Huff | 431/354 | |
| 2,047,471 | A * | 7/1936 | Hepburn | F23C 3/002 | 126/299 R |
| 2,483,081 | A * | 9/1949 | Wrigley | F23D 14/38 | 431/345 |
| 2,796,118 | A * | 6/1957 | Parker et al. | 431/17 | |
| 3,101,769 | A * | 8/1963 | Smith et al. | 431/175 | |
| 3,161,228 | A * | 12/1964 | Willi | 431/9 | |
| 3,360,967 | A * | 1/1968 | Massie | F23D 14/28 | 222/3 |
| 4,157,241 | A * | 6/1979 | Samuelson | B01F 3/04049 | 126/91 A |
| 4,631,023 | A * | 12/1986 | Courrege | 431/329 | |
| 4,886,446 | A * | 12/1989 | Courrege | 431/329 | |
| 4,992,041 | A * | 2/1991 | Kewish et al. | 431/126 | |
| 5,111,538 | A * | 5/1992 | Chapman | 4/599 | |
| 5,588,823 | A * | 12/1996 | Wu | 431/241 | |
| 6,132,204 | A | 10/2000 | Snyder et al. | | |
| 6,378,551 | B1 | 4/2002 | Long | | |
| 6,468,072 | B2 | 10/2002 | Shook | | |
| 8,650,915 | B2 * | 2/2014 | Borders et al. | 65/528 | |
| 2003/0022119 | A1 * | 1/2003 | Wong | F23Q 2/165 | 431/255 |
| 2003/0161755 | A1 * | 8/2003 | Richards | 422/5 | |
| 2005/0202361 | A1 * | 9/2005 | Albizuri | F24C 3/124 | 431/354 |
| 2006/0199124 | A1 * | 9/2006 | Lyles | F23D 14/725 | 431/75 |

OTHER PUBLICATIONS

"Gas Valve Orifice Sizing—rego.pdf", LP Gas Serviceman's Manual, Rego Products, p. 45, 1962.*

"Gas Valve Orifice Sizing—ASCO.pdf", Engineering Information, ASCO, p. 476.*

Past Fittings, Other information submitted for consideration by the Office, document includes images and descriptions of gas fittings sold during the 2010 calendar year.

* cited by examiner

LIGHTING APPARATUS

This application claims the benefit of provisional application No. 61/640,307 filed on Apr. 30, 2012 and entitled Gas Fitting Apparatus for Lamps and Lanterns.

Lighting apparatus described herein may be used in gas lantern lighting fixtures. Various lighting apparatus disclosed herein are capable of producing a broad and aesthetically pleasing flame pattern using less gas than many conventional lighting apparatus. Lighting apparatus described herein may further be useful due to the ease of assembly of the apparatus and the assembled apparatus may have only a small number of connections, thereby reducing the opportunities for leaks. Lighting apparatus described herein may further possess features which limit the total flame produced by the apparatus thereby enhancing safety and protecting associated equipment.

Lighting apparatus described herein may, for example, comprise: a first body member comprising a horizontally oriented gas inlet, a vertically oriented gas outlet, and a fastener, wherein the first body member is a single piece; a valve; an orifice; a burner tip; an interruptible flow path connecting the first body member, the valve, the orifice, and the burner tip; wherein the valve is arranged and configured to close the interruptible flow path. In a related example the orifice may have a diameter of less than 1.2 mm. In a further related example the orifice may have a diameter of less than 1.6 mm. In a further related example, the horizontally oriented gas inlet may be arranged and configured to accept tubing by compression fitting. In a further related example, the fastener may be a threaded fastener. In a further related example, the fastener may be a threaded stud. In a further related example the valve, the orifice, the burner tip, and the first body member may be aligned vertically. In a further related example, the burner tip may be arranged and configured to produce a flame having a flame width and a flame height, wherein the flame width is greater than 0.35 times the flame height. In a still further related example, the burner tip may be arranged and configured to produce a flame having a flame width, wherein the flame width is greater than 0.75 inches. In a further related example, the maximum flame height may be less than 5 inches.

Lighting apparatus described herein may, for example, comprise: a burner comprising: a first gas supply orifice, an air supply orifice, and a burner tip slot; a second gas supply orifice; a fastener; and a valve. In a related example, the fastener may be arranged and configured to secure the burner within a gas lantern lighting fixture. In a further related example, the second gas supply orifice may have an orifice diameter of less than 1.2 mm. In a further related example, the second gas supply orifice may have an orifice diameter of less than 1.6 mm. In a further related example, the burner, the second gas supply orifice, and the valve may be arranged and configured to produce a flame; wherein the flame has a flame height, a flame width, and a gas utilization rate; wherein the flame width is greater than 0.75 inches; and wherein the gas utilization rate is less than 1000 BTU/hour. In a further related example, the flame width may be greater than 1.0 inch. In a further related example, the gas utilization rate may be less than 900 BTU/hour. In a further related example, the flame height may be greater than 1.0 inches. In a still further related example, the flame height may be less than 3.0 inches. In a still further related example, the flame height may be less than 2.5 inches.

DETAILED DESCRIPTION

EXAMPLE 1

Figure 1:
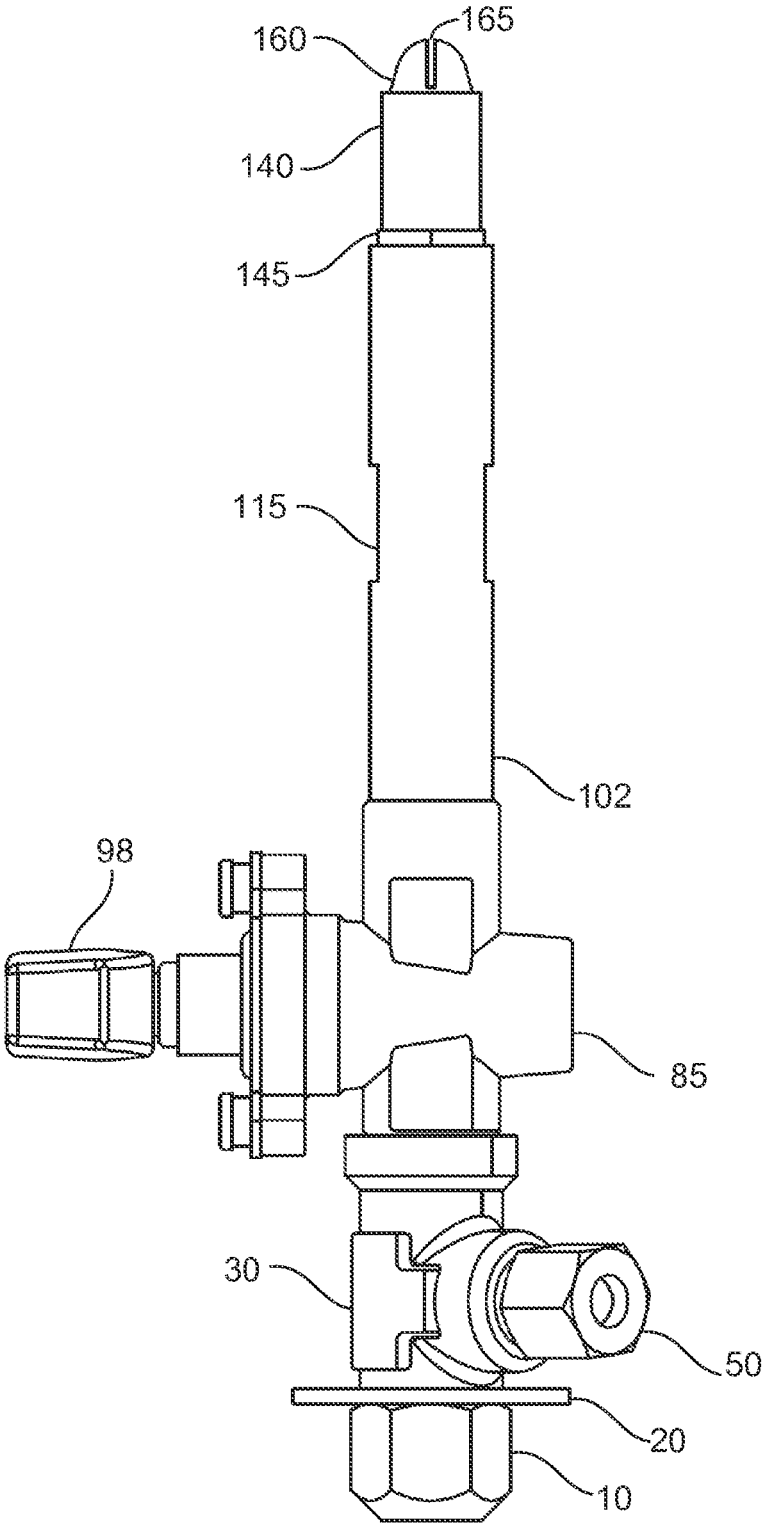
FIG. 1 depicts a side view of a lighting apparatus.

Referring now to FIG. 1 of the drawings, Base assembly lower hex cap 10 may be used in conjunction with Base assembly support washer 20, and Base assembly body 30 to secure the lighting apparatus into a fixed position at the base of a gas lantern lighting fixture wherein Base assembly lower hex cap 10 is used to compress Base assembly support washer 20 against an interior floor of the gas lantern lighting fixture. The interior floor of the gas lantern lighting fixture is generally situated in a horizontal orientation. Natural gas or liquefied petroleum gas is supplied to the lighting apparatus at Base assembly body 30 by way of metal tubing which is commonly copper tubing. The metal tubing is fixed to Base assembly body 30 in part through the use of Compression nut 50. Gas ultimately flows upward through Base assembly body 30 to Valve assembly 85 where the flow of gas to Burner 140 may be regulated by manually positioning Valve handle 98. Upper vertical extension coupling 102 carries gas from Valve assembly 85 to Burner 140. Burner hexagon wrench grip 145 is used to screw Burner 140 into Upper vertical extension coupling wrench grip 115. Burner 140 mixes air with the gas so that a flame may be produced at Burner tip 160 and more specifically at Burner tip slot 165.

Figure 2:
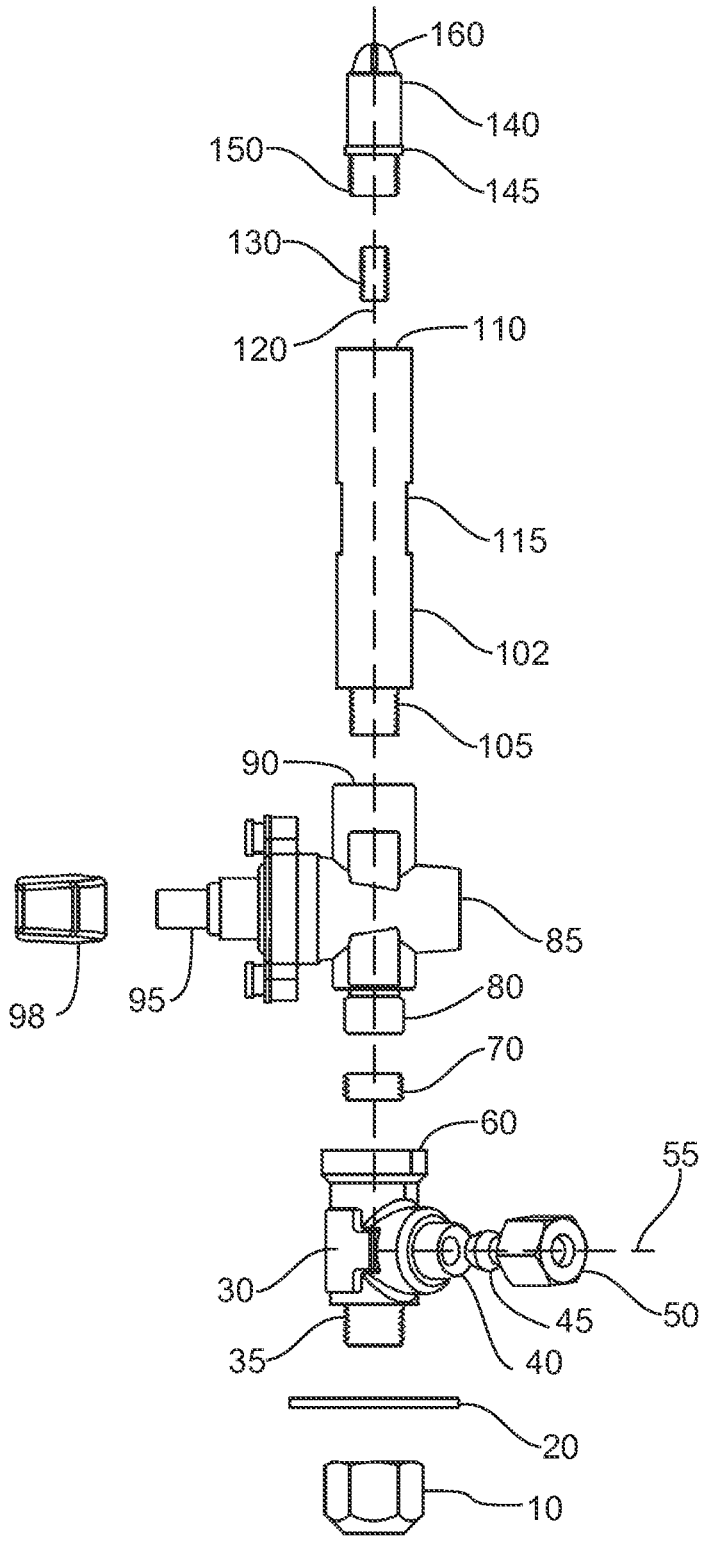
FIG. 2 depicts an exploded side view of a lighting apparatus.

Referring now to FIG. 2 of the drawings, Base assembly lower hex cap 10 is screwed onto Base assembly support stud 35 such that Base assembly support washer 20 secures the lighting apparatus against the interior floor of a gas lantern lighting fixture. Base assembly support stud 35 is a mechanical fastening element, through which there is no flow path. Horizontal flow axis 55 and Vertical flow axis 120, both shown as dashed lines in FIG. 2, represent the flow path of gas through the lighting apparatus and represent axes around which some elements are partially symmetrical. Compression fitting 40 represents the point of entry of gas into the lighting apparatus and Ferrule 45 and Compression nut 50 secure tubing, through which gas is supplied to the lighting apparatus, to Base assembly body 30. Valve assembly 85 is connected to Base assembly body 30 by Lower close threaded nipple 70 which screws into both Valve assembly lower female threaded end 80 and Base assembly top union 60. Valve assembly 85 comprises Valve stem 95 and Valve handle 98. Upper vertical extension coupling 102 has a length that allows for the positioning of Burner 140 within a gas lantern lighting fixture such that the flame that comes from Burner 140 is positioned at a visually pleasing location within the gas lantern lighting fixture. Upper vertical extension coupling lower male threaded end 105 screws into Valve assembly upper female threaded end 90 with the assistance of Upper vertical extension coupling wrench grip 115. Upper vertical extension coupling wrench grip 115 may take the form of two notches in the side wall of Upper vertical extension coupling 102 which form parallel surfaces suitable for gripping by a wrench. Upper vertical extension coupling upper double female threaded end 110 is a threaded female connector positioned both inside and below another threaded female connector. The innermost threaded connection point is arranged and configured to receive Upper close threaded nipple orifice 130 and the other interior female threaded connection point is configured to receive Burner male threaded end 150. Upper close threaded nipple orifice 130 is configured such that it has an orifice situated along Vertical flow axis 120 and situated in the lower portion of Upper close threaded nipple orifice 130. Upper close threaded nipple orifice 130 further has a hexagonal socket positioned along Vertical flow axis 120 and in the upper portion of Upper close threaded nipple orifice 130 such that a hex key can screw Upper close threaded nipple orifice 130 into the innermost threaded connection point of Upper vertical extension coupling upper double female threaded end 110 and such that upon removal of the hex key the only substantial flow restriction in Upper close threaded nipple orifice 130 is the orifice itself Burner male threaded end 150 screws into the other interior female threaded connection point of Upper vertical extension coupling upper double female threaded end 110 using Burner hexagon wrench grip 145 such that Burner hexagon wrench grip 145 fits closely to the upper surface of Upper vertical extension coupling upper double female threaded end 110. Burner 140 consumes fuel at Burner tip 160.

The embodiment depicted in FIG. 1 and FIG. 2 of the drawings, is an embodiment in which Valve stem 95 is positioned at 135° rotation from Compression fitting 40 using Vertical flow axis 120 as a frame of reference. In an alternate embodiment Valve stem 95 is positioned at 180° rotation from Compression fitting 40.

Figure 4:
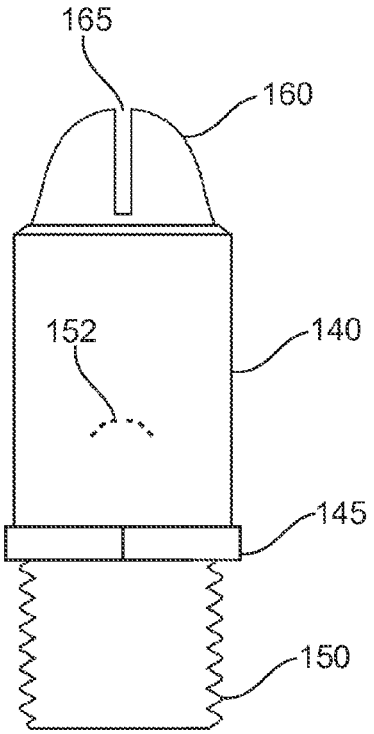
FIG. 4 depicts a side view of a burner.

Referring now to FIG. 4 of the drawings, Burner 140 comprises Burner hexagon wrench grip 145, Burner male threaded end 150, Burner tip 160, and Burner tip slot 165. Burner tip 160 has a rounded top and is bell shaped with the lowermost portion of Burner tip 160 arcing outward near the body of Burner 140. Burner internal orifice 152 (shown as a dashed line) is centrally located within Burner 140 and restricts the flow of fuel traveling from the lower portion of Burner 140 toward Burner tip 160.

Figure 5:
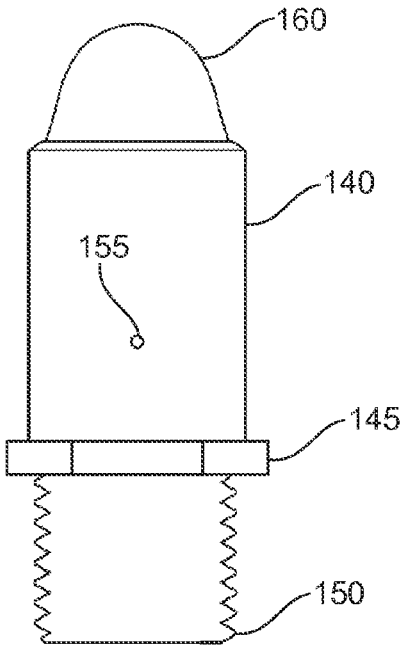
FIG. 5 depicts a frontal view of a burner.

Referring now to FIG. 5 of the drawings, Burner 140 is substantially as depicted in FIG. 4, but rotated 90°. Each of Burner hexagon wrench grip 145, Burner male threaded end 150, and Burner tip 160 are configured similarly to the depiction in FIG. 4. Burner air inlet orifice 155 is on the side of Burner 140 allowing for the introduction of combustion air into the interior of Burner 140. Another equivalent Burner air inlet orifice 155 is similarly positioned on the opposite side of Burner 140.

Referring collectively to FIGS. 4 and 5 of the drawings, Burner internal orifice 152 is at the uppermost point of a raised barrier separating Burner 140 into an upper chamber and a lower chamber. Burner air inlet orifice 155 allows a limited amount of combustion air into the upper chamber at a height that is approximately the same as the height of Burner internal orifice 152.

In the embodiments represented by FIGS. 1-5, Burner tip slot 165 may be 0.55 mm wide for natural gas and 1.2 mm wide for liquefied petroleum gas. In separate but related embodiments, Burner tip slot 165 may be less than 1.4 mm wide, less than 1.0 mm wide and less than 0.7 mm wide.

In the embodiments represented by FIGS. 1-5, Burner internal orifice 152 may be may be a square orifice measuring 0.74 mm×0.74 mm for natural gas and 0.67 mm×0.67 mm for liquefied petroleum gas. Burner air inlet orifice 155 may be a 0.9 mm orifice for natural gas and a 4.7 mm orifice for liquefied petroleum gas.

In the embodiments represented by FIGS. 1-5, Upper close threaded nipple orifice 130 may have an orifice diameter for natural gas of 0.8 mm and an orifice diameter for liquefied petroleum gas of 0.5 mm. In separate but related embodiments, the orifice in Upper close threaded nipple orifice 130 may have a diameter of less than 1.2 mm and the orifice in Upper close threaded nipple orifice 130 may have a diameter of less than 1.6 mm.

As that term is used herein "orifice" encompasses all non-adjustable flow restrictions that may be used to significantly restrict the flow of fuel or air regardless of geometry. References to orifice diameter made herein are made to characterize the degree of flow restriction and for that reason; a reference to the diameter of a non-circular orifice designates the diameter of the circular orifice that would produce an equivalent flow restriction.

In certain embodiments, the orifice in Upper close threaded nipple orifice 130 is sized to limit the total flame height produced by the burner such that the flame height of the burner stays below three inches when valve is fully open. In other embodiments, the orifice in Upper close threaded nipple orifice 130 is sized to limit the total flame height produced by the burner such that the flame height of the burner stays below four inches when valve is fully open. In still other embodiments, the orifice in Upper close threaded nipple orifice 130 is sized to limit the total flame height produced by the burner such that the flame height of the burner stays below five inches when valve is fully open. These limitations may have the effect of protecting gas lantern lighting fixtures from damage and protecting users of those from injury due to excessive flame. The maximum flame height of the lighting apparatus is defined as the flame height when the valve is fully open.

EXAMPLE 2

Figure 3:
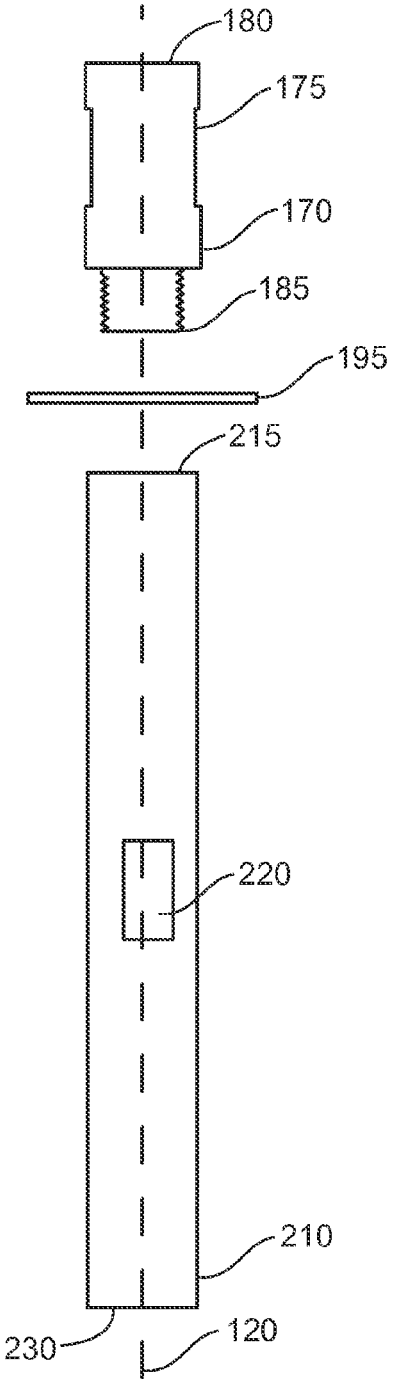
FIG. 3 depicts a lower assembly of an embodiment of a lighting apparatus.

Referring now to FIG. 3 of the drawings, in embodiments in which the gas lantern lighting fixture is mounted on a post or pole gas is designed to come from below the gas lantern lighting fixture. In such situations, the lighting apparatus may be substantially as described in Example 1 from Lower close threaded nipple 70 to Burner tip 160 including Lower close threaded nipple 70. However, fittings below Lower close threaded nipple 70 may be as follows. Lower vertical extension coupling 170 may screw into Lower close threaded nipple 70 at Lower vertical extension coupling upper female threaded end 180. Lower vertical extension coupling 170 may have a Lower vertical extension coupling wrench grip 175 which may take the form of two notches in the side wall of Lower vertical extension coupling 170 which form parallel surfaces suitable for gripping by a wrench. Sub-fixture vertical extension coupling upper female threaded end 215 screws into Lower vertical extension coupling lower male threaded end 185 such that the floor of a gas lantern lighting fixture is sandwiched between Mounting washer 195 and Sub-fixture vertical extension coupling upper female threaded end 215, securing the lighting apparatus in place within the gas lantern lighting fixture. Sub-fixture vertical extension coupling 210 may have a Sub-fixture vertical extension coupling wrench grip 220 which may take the form of two notches in the side wall of Sub-fixture vertical extension coupling 210 which form parallel surfaces suitable for gripping by a wrench. Sub-fixture vertical extension coupling 210, Mounting washer 195, and Lower vertical extension coupling 170 are each aligned along Vertical flow axis 120 which in the present embodiment, is the centerline of the gas flow path through the lighting apparatus. Sub-fixture vertical extension coupling lower female threaded end 230 optionally serves as the point of attachment of a compression fitting which connects the lighting apparatus to gas tubing running through the post or pole.

EXAMPLE 3

Figure 6:
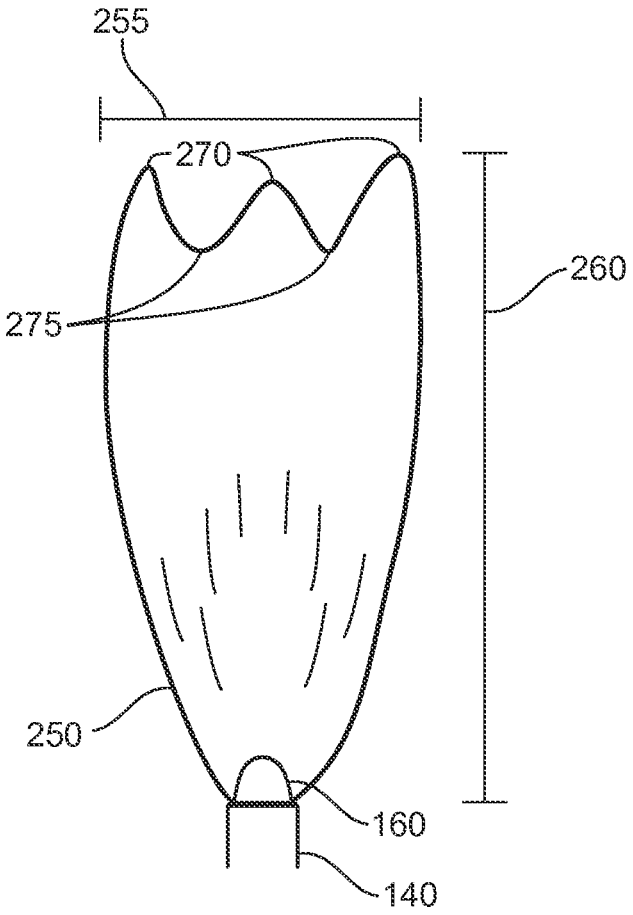
FIG. 6 depicts a frontal view of a flame produced at a burner.

Referring now to FIG. 6 of the drawings, Flame 250 departs from Burner tip 160 which is a component of Burner 140. The above referenced orifice and Burner tip 160 design produce a flame of particular aesthetic character having a Flame width 255 and a Flame height 260. Additionally the flame may have multiple Flame peaks 270 and multiple Flame valleys 275. Table 1 describes a variety of combined characteristics that may be attributable to Flame 250. Flame 250 may, for example, have a flame height of less than 3 inches, a flame width of greater than 1 inch, a flame width to height ratio greater than 0.35, and consume less than 900 BTUs per hour as described in Example 3.01. Examples of alternate flame characteristics are similarly described in Examples 3.02-3.32 in Table 1.

TABLE 1

| Example | Flame height (in.) | Flame width (in.) | Width/height ratio | Gas utilization (BTU/hr.) |
|---|---|---|---|---|
| 3.01 | <3.0 | >1.0 | >0.35 | <900 |
| 3.02 | <2.5 | >1.0 | >0.35 | <900 |
| 3.03 | >1.5 | >1.0 | >0.35 | <900 |
| 3.04 | >1.0 | >1.0 | >0.35 | <900 |
| 3.05 | <3.0 | >0.75 | >0.35 | <900 |
| 3.06 | <2.5 | >0.75 | >0.35 | <900 |
| 3.07 | >1.5 | >0.75 | >0.35 | <900 |
| 3.08 | >1.0 | >0.75 | >0.35 | <900 |
| 3.09 | <3.0 | >1.0 | >0.45 | <900 |
| 3.10 | <2.5 | >1.0 | >0.45 | <900 |
| 3.11 | >1.5 | >1.0 | >0.45 | <900 |
| 3.12 | >1.0 | >1.0 | >0.45 | <900 |
| 3.13 | <3.0 | >0.75 | >0.45 | <900 |
| 3.14 | <2.5 | >0.75 | >0.45 | <900 |
| 3.15 | >1.5 | >0.75 | >0.45 | <900 |
| 3.16 | >1.0 | >0.75 | >0.45 | <900 |
| 3.17 | <3.0 | >1.0 | >0.35 | <1000 |
| 3.18 | <2.5 | >1.0 | >0.35 | <1000 |
| 3.19 | >1.5 | >1.0 | >0.35 | <1000 |
| 3.20 | >1.0 | >1.0 | >0.35 | <1000 |
| 3.21 | <3.0 | >0.75 | >0.35 | <1000 |
| 3.22 | <2.5 | >0.75 | >0.35 | <1000 |
| 3.23 | >1.5 | >0.75 | >0.35 | <1000 |
| 3.24 | >1.0 | >0.75 | >0.35 | <1000 |
| 3.25 | <3.0 | >1.0 | >0.45 | <1000 |
| 3.26 | <2.5 | >1.0 | >0.45 | <1000 |
| 3.27 | >1.5 | >1.0 | >0.45 | <1000 |
| 3.28 | >1.0 | >1.0 | >0.45 | <1000 |
| 3.29 | <3.0 | >0.75 | >0.45 | <1000 |
| 3.30 | <2.5 | >0.75 | >0.45 | <1000 |
| 3.31 | >1.5 | >0.75 | >0.45 | <1000 |
| 3.32 | >1.0 | >0.75 | >0.45 | <1000 |

Functional descriptions which may vary depending on the supply pressure of the gas are descriptive of a situation in which a steady supply of 0.2 psig natural gas is available to the apparatus or descriptive of a situation in which a steady supply of vapor phase 0.4 psig liquefied petroleum gas is available to the apparatus.

The above-described embodiments have a number independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

I claim:

1. A lighting apparatus comprising:

a. a first body member comprising
   i. a horizontally oriented gas inlet,
   ii. a vertically oriented gas outlet, and
   iii. a fastener,
   iv. wherein the first body member is a single piece;

b. a valve located vertically above the first body member;

c. an orifice;

d. a burner comprising burner tip and an air inlet, wherein the burner is located vertically above the valve;

e. a vertical extension coupling situated between the burner and the valve wherein the vertical extension coupling is removably attached to the burner and wherein the vertical extension coupling is removably attached to the valve; and f. an interruptible flow path connecting the first body member, the valve, the orifice, and the burner tip;

g. wherein the valve is arranged and configured to close the interruptible flow path;

h. wherein the orifice is removably attached to and located within the vertical extension coupling;

i. wherein the vertically oriented gas outlet, the fastener, the orifice, and the vertical extension coupling are in coaxial alignment;

j. wherein the fastener is located at the base of the first body member; and k. wherein the orifice discharges vertically.

2. The lighting apparatus of claim 1 wherein the orifice has a diameter of less than 1.2 mm.

3. The lighting apparatus of claim 1 wherein the orifice has a diameter of less than 1.6 mm.

4. The lighting apparatus of claim 1 wherein the horizontally oriented gas inlet is arranged and configured to accept tubing by compression fitting.

5. The lighting apparatus of claim 1 wherein the fastener is a threaded fastener.

6. The lighting apparatus of claim 1 wherein the fastener is a threaded stud.

7. The lighting apparatus of claim 1 wherein the valve, the orifice, the burner tip, and the first body member are aligned vertically.

8. The lighting apparatus of claim 1 wherein the burner tip is arranged and configured to produce a flame having a flame width and a flame height, wherein the flame width is greater than 0.35 times the flame height.

9. The lighting apparatus of claim 1 wherein the burner tip is arranged and configured to produce a flame having a flame width, wherein the flame width is greater than 0.75 inches.

10. The lighting apparatus of claim 1 wherein the maximum flame height is less than 5 inches.

11. A lighting apparatus comprising:

a. a burner comprising:
   i. a first gas supply orifice,
   ii. an air supply orifice,
   iii. a burner tip slot;

b. a second gas supply orifice;

c. a fastener located at the base of a body wherein the body comprises a horizontally oriented gas inlet and a vertically oriented gas outlet;

d. a valve located vertically above the fastener and vertically below the burner; and e. a vertical extension coupling situated between the burner and the valve wherein the vertical extension coupling is removably attached to the burner and wherein the vertical extension coupling is removably attached to the valve;

f. wherein the first gas supply orifice is removably attached to and located within the vertical extension coupling;

g. wherein the fastener, the first gas supply orifice, the second gas supply orifice and the vertical extension coupling are in coaxial alignment; and h. wherein the second gas supply orifice discharges vertically.

12. The lighting apparatus of claim 11 wherein the fastener is arranged and configured to secure the burner within a gas lantern lighting fixture.

13. The lighting apparatus of claim 11 wherein the second gas supply orifice has an orifice diameter of less than 1.2 mm.

14. The lighting apparatus of claim 11 wherein the second gas supply orifice has an orifice diameter of less than 1.6 mm.

15. The lighting apparatus of claim 11:

a. wherein the burner, the second gas supply orifice, and the valve are arranged and configured to produce a flame;

b. wherein the flame has a flame height, a flame width, and a gas utilization rate;

c. wherein the flame width is greater than 0.75 inches; and d. wherein the gas utilization rate is less than 1000 BTU/hour.

16. The lighting apparatus of claim 15 wherein the flame width is greater than 1.0 inch.

17. The lighting apparatus of claim 15 wherein the gas utilization rate is less than 900 BTU/hour.

18. The lighting apparatus of claim 15 wherein the flame height is greater than 1.0 inches.

19. The lighting apparatus of claim 15 wherein the flame height is less than 3.0 inches.

20. The lighting apparatus of claim 15 wherein the flame height is less than 2.5 inches.

* * * * *